US010181387B2

(12) United States Patent
Kim et al.

(10) Patent No.: US 10,181,387 B2
(45) Date of Patent: Jan. 15, 2019

(54) ELECTROMAGNETIC REPULSION ACTUATOR FOR CIRCUIT BREAKER

(71) Applicant: HYOSUNG HEAVY INDUSTRIES CORPORATION, Seoul (KR)

(72) Inventors: Nam Kyung Kim, Changwon-si (KR); Young Hwan Chung, Changwon-si (KR); Hui Dong Hwang, Changwon-si (KR)

(73) Assignee: HYOSUNG HEAVY INDUSTRIES CORPORATION, Seoul (KR)

( * ) Notice: Subject to any disclaimer, the term of this patent is extended or adjusted under 35 U.S.C. 154(b) by 0 days.

(21) Appl. No.: 15/540,970

(22) PCT Filed: Dec. 30, 2015

(86) PCT No.: PCT/KR2015/014490
§ 371 (c)(1),
(2) Date: Jun. 29, 2017

(87) PCT Pub. No.: WO2016/108622
PCT Pub. Date: Jul. 7, 2016

(65) Prior Publication Data

US 2017/0352507 A1 Dec. 7, 2017

(30) Foreign Application Priority Data

Dec. 31, 2014 (KR) ..... 10-2014-0195573

(51) Int. Cl.
*H01H 33/38* (2006.01)
*H01H 50/02* (2006.01)
(Continued)

(52) U.S. Cl.
CPC ..... *H01H 33/38* (2013.01); *H01H 33/285* (2013.01); *H01H 33/6647* (2013.01);
(Continued)

(58) Field of Classification Search
CPC ..... H01H 33/285
See application file for complete search history.

(56) References Cited

FOREIGN PATENT DOCUMENTS

JP 2003-016886 A 1/2003
JP 4500972 A 4/2010
(Continued)

*Primary Examiner* — Ramon M Barrera
(74) *Attorney, Agent, or Firm* — Novick, Kim & Lee, PLLC; Jae Youn Kim

(57) ABSTRACT

An electromagnetic repulsion actuator for a circuit breaker is provided. The actuator can include a housing; a first fixed electrode having therein an operating space open at both sides; a pair of movable electrodes capable of reciprocally moving and being electrically connected to the first fixed electrode; second fixed electrodes selectively contacting the pair of movable electrodes to be electrically connected thereto, thereby transferring power supplied from a first side to a second side; and actuating coils selectively moving the movable electrodes in a direction of being separated from the second fixed electrodes by generating electromagnetic force from induced current. In the present invention as above, the structure of a circuit breaker is simplified and moving speeds of the movable electrodes are increased since the movable electrodes move by using induced current generated by a close coil and open coils to perform an open operation.

10 Claims, 3 Drawing Sheets

(51) Int. Cl.

| | |
|---|---|
| ***H01H 50/64*** | (2006.01) |
| ***H01H 33/28*** | (2006.01) |
| ***H01H 33/664*** | (2006.01) |
| *H01H 33/666* | (2006.01) |

(52) U.S. Cl.
CPC ..... *H01H 50/02* (2013.01); *H01H 50/641* (2013.01); *H01H 33/6662* (2013.01)

(56) References Cited

FOREIGN PATENT DOCUMENTS

| | | | |
|---|---|---|---|
| KR | 10-2000-0008930 | A | 2/2000 |
| KR | 10-2002-0072050 | A | 9/2002 |
| KR | 10-2009-0113687 | A | 11/2009 |
| KR | 10-2015-0030489 | A | 3/2015 |

ELECTROMAGNETIC REPULSION ACTUATOR FOR CIRCUIT BREAKER

TECHNICAL FIELD

The present invention relates to an electromagnetic repulsion actuator for a circuit breaker. More particularly, the present invention relates to an electromagnetic repulsion actuator for a circuit breaker in which movable electrodes are operated at both sides using electromagnetic repulsion.

BACKGROUND ART

In general, gas insulated switchgears (GIS) relate to power subsystem equipment that improves reliability by storing conductors and various protection devices in a metallic sealed tank and by using an insulating gas that is excellent in insulating performance and arc extinguishing as an insulating medium. Gas insulated switchgears are configured in a complex manner with various components such as breaker, disconnecting switch, grounding switch, etc.

Among the components, circuit breakers are used to safely protect a power system by switching a normal load of a gas insulated switchgear, and by blocking system fault current in an occurrence of abnormal state such as short circuit, grounding, or other accidents of a power line. In circuit breakers, an open operation or a close operation is performed by a fixed electrode and a movable electrode which are connected to each other and interwork therewith.

In addition to gas circuit breakers, vacuum circuit breakers are used. Vacuum circuit breakers are circuit and appliance protecting apparatuses in which an arc generated when switching a normal load or blocking a fault current is extinguished in a vacuum interrupter in order to rapidly separate a circuit. Such a vacuum interrupter, as a key component of a circuit breaker, is configured with a movable contact and a fixed contact which are provided inside an insulated housing with a vacuum state therein, so that an arc generated when switching is performed is rapidly extinguished. Thus, vacuum circuit breakers are used as contacting devices for switching a power system.

Accordingly, in the conventional vacuum interrupter, an open operation and a close operation are performed by the movable contact and the fixed contact which interwork therewith. However, speed in forming and releasing a short circuit is limited since a movable electrode only straightly moves to contact and separate from a fixed electrode that is fixed at one side. Particularly, in a high voltage direct current system, such speed is important since forming and releasing a short circuit in a vacuum interrupter has to be performed at a high speed. However, in a conventional method, there is a limit to increasing speed since the movable electrode only moves to form and release the short circuit.

In order to solve the above problems, a technique in which an electromagnetic force actuator is used for moving a fixed arc contact so that the fixed arc contact and a movable arc contact separate far away from each other is provided. However, it is difficult to quickly move the contact by using the electromagnetic force actuator. In addition, it is problematic in that the fixed arc contact and the movable arc contact have to be controlled in separate mechanisms.

Particularly, due to characteristics of the circuit breaker, performance for rapidly blocking the circuit is very important, thus there is a need to increase blocking speed by relatively moving the fixed contact and the movable contact at a high speed.

DISCLOSURE

Technical Problem

Accordingly, the present invention has been made keeping in mind the above problems occurring in the prior art, and an object of the present invention is to enable a pair of movable electrodes to move quickly and rapidly perform open/close operations by using electromagnetic force.

Technical Solution

According to the characteristics of the present invention for accomplishing the above object as described above, the present invention includes: a housing; a first fixed electrode provided inside the housing and having therein an operating space open at both sides; a pair of movable electrodes installed in the first fixed electrode at both sides of the operating space thereof, the movable electrodes being capable of reciprocally moving and being electrically connected to the first fixed electrode; second fixed electrodes respectively spaced apart from the first fixed electrode and installed inside the housing at both sides thereof, and selectively contacting the pair of movable electrodes to be electrically connected thereto, thereby transferring power supplied from a first side to a second side; and actuating coils selectively moving the movable electrodes in directions of being separated from the second fixed electrodes by generating electromagnetic force from induced current.

The actuating coils may include: a close coil provided in the first fixed electrode inside the operating space thereof, generating electromagnetic force from induced current in the movable electrodes at first ends thereof by using applied current, and moving the movable electrodes toward the second fixed electrodes; open coils installed to be respectively spaced apart from both sides of the close coil, generating electromagnetic force from induced current in the movable electrodes at the first ends thereof by using applied current, and moving the movable electrodes so that the movable electrodes separate from the first fixed electrode.

Each of the movable electrodes may include: a moving bar extending in a moving bar extending in a moving direction of an associated movable electrode; an induction plate provided on the moving bar at a first end facing a close coil; and an operation plate provided on the moving bar at a second end thereof opposite to the induction plate, and selectively contacting an associated second fixed electrode.

The close coil may be installed in the first fixed electrode at the center of the operating space thereof, the open coils are installed to be respectively spaced apart from both sides of the close coil, and the induction plates of the movable electrodes straightly and reciprocally move between the open coils and the close coil.

The open coils may be respectively installed in the first fixed electrode at both sides of the operation space thereof, and push the pair of movable electrodes toward the close coil and selectively separate the operation plates of the movable electrodes from the second fixed electrodes.

The first fixed electrode may be provided with through holes having contact springs therein, the moving bars passing through the through holes, so that the contact springs electrically connect the moving bars and the first fixed electrode.

The housing may maintain a vacuum state therein.

The first fixed electrode may be installed to be spaced apart from an inner surface of the housing through insulating spacers.

At least one of the close coil and the open coils may be connected to a power supplier via the insulating spacers, the power supplier supplying current thereto.

Advantageous Effects

According to an electromagnetic repulsion actuator for a circuit breaker of the present invention, the following effects may be expected.

In the present invention, an open operation is performed by moving movable electrodes using induced current generated by a closed coil and open coils, thereby a configuration of the electromagnetic repulsion actuator is simplified, and blocking performance of the circuit breaker is improved since moving speeds of the movable electrodes are increased.

Particularly, in the present invention, the movable electrodes are operated at both sides, thereby an open operation may be performed at a higher speed since moving strokes of the movable electrodes are relatively shortened.

In addition, in the present invention, a pair of movable electrodes constitutes the electromagnetic repulsion actuator by being respectively connected to second fixed electrodes thus forming two contacts. Accordingly, the electromagnetic repulsion actuator may be applied to a relatively high-voltage circuit breaker. In addition, since two electrodes are driven by a single actuator, the manufacturing cost of the actuator can be reduced.

In addition, in the present invention, in order to perform an open operation or a close operation, two movable electrodes are driven at both sides by using open coils and a close coil which are disposed in the center of the electromagnetic repulsion actuator rather than using separate driving units for the two movable electrodes, thereby a configuration of the electromagnetic repulsion actuator is simplified.

MODE FOR INVENTION

Figure 1:
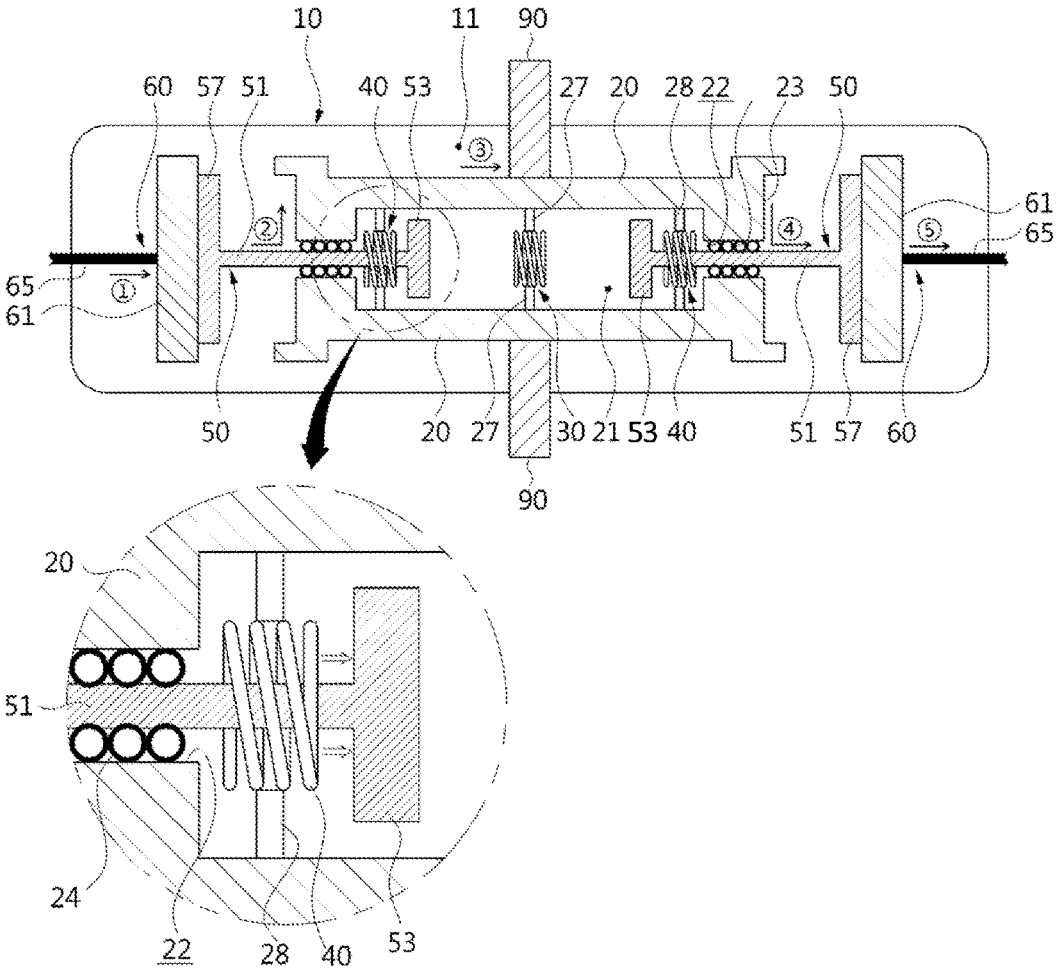
FIG. 1 is a conceptual diagram showing a configuration of a preferred embodiment of an electromagnetic repulsion actuator for a circuit breaker of the present invention.
Figure 2:
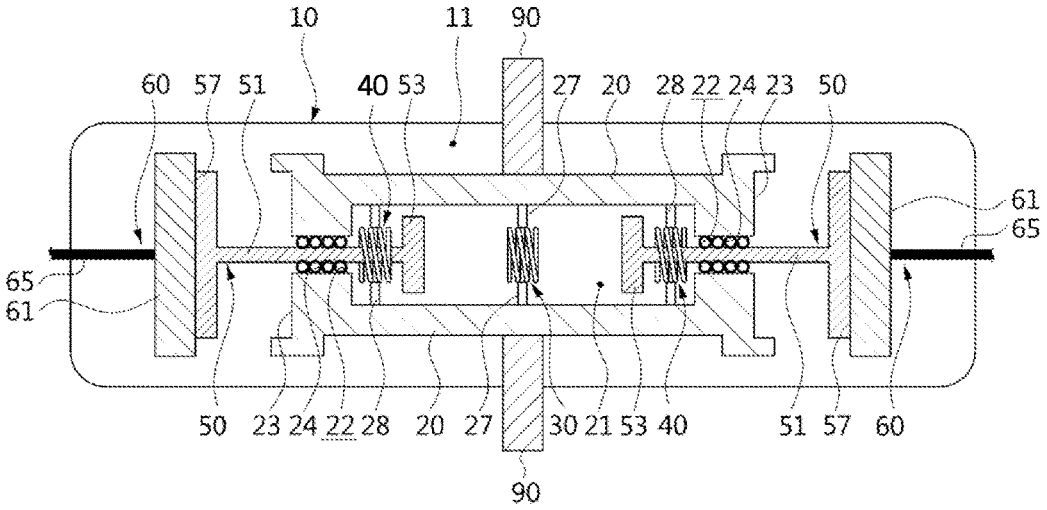
FIG. 2 is a conceptual diagram showing a closed state in which movable electrodes and second fixed electrodes which constitute the embodiment of the present invention contact each other.

Hereinafter, exemplary embodiments of the present invention will be described with reference to the accompanying drawings. In the following description, the same elements will be designated by the same reference numerals although they are shown in different drawings. Further, in the following description of the present invention, detailed descriptions of known functions and configurations incorporated herein will be omitted when it may make the subject matter of the present invention unclear.

In addition, terms, such as first, second, A, B, (a), (b) or the like may be used herein when describing components of the present invention. These terms are merely used to distinguish one structural element from other structural elements, and a property, an order, a sequence and the like of a corresponding structural element are not limited by the term. It should be noted that if it is described in the specification that one component is "connected", "coupled", or "joined" to another component, a third component may be "connected", "coupled", and "joined" between the first and second components, although the first component may be directly connected, coupled or joined to the second component.

FIG. 1 is a conceptual diagram showing a configuration of a preferred embodiment of an electromagnetic repulsion actuator for a circuit breaker of the present invention.

An electromagnetic repulsion actuator for a circuit breaker of the present invention includes a housing 10. The housing 10 forms the exterior and a frame of the electromagnetic repulsion actuator, and is formed with an inner space 11 thereinside. Herein, the inner space 11 may be maintained in a vacuum state.

In the housing 10, a first fixed electrode 20 is provided in the inner space 11. The first fixed electrode 20 is connected to second fixed electrodes 60 through movable electrodes 50 which will be described later, so that power is input thereto. For this, the first fixed electrode 20 itself is configured with a conductor having high electrical conductivity.

The first fixed electrode 20 has a structure similar to the structure of the housing 10, and which is disposed in the inner space 11 of the housing 10. In other words, the first fixed electrode 20 is formed with an operating space 21 thereinside, the operating space 21 is open at both sides so that parts of the movable electrodes 50 go in and out.

As shown in FIG. 1, the first fixed electrode 20 is provided with through holes 22 at both sides of the operating space 21, and the movable electrodes 50 may straightly and reciprocally move through the through holes 22 with moving bars 51 thereof which will be described later.

The through holes 22 are respectively provided with contact springs 24 thereinside. The contact springs 24 are fixed inside the through holes 22 and electrically connect the moving bars 51 of the movable electrodes 50 and the first fixed electrode 20. In other words, the contact springs 24 function such that current smoothly flows between the first fixed electrode 20 and the movable electrodes 50. At the same time, the contact springs 24 reduce friction generated when the moving bars 51 of the movable electrodes 50 move along inner surfaces of the through holes 22.

The first fixed electrode 20 is formed with seat portions 25 at both outer surfaces thereof. The seat portions 25 are formed in a plate shape at both outer surfaces of the first fixed electrode 20 so that operation plates 57 of the movable electrodes 50 which will be described later are selectively placed therein.

The first fixed electrode 20 is provided with installing means 27 and 28 in the operating space 21 thereof. The installing means 27 and 28 are used to install a close coil 30 and open coils 40, which will be described later, inside the operating space 21. A variety of embodiments are possible when the close coil 30 and the open coils 40 are fixed by using the same.

Actuating coils 30 and 40 are installed inside the operating space 21 of the first fixed electrode 20. The actuating coils 30 and 40 form induced current in the movable electrodes 50 by using current applied from the outside, and straightly and reciprocally move the movable electrodes 50 by using the induced current. In the present embodiment, the actuating coils 30 and 40 are configured with the close coil 30 and the open coils 40.

The close coil 30 performs a close operation by moving the movable electrodes 50, and is disposed in the center of the operating space 21. The close coil 30 is installed to face to the movable electrodes 50 at both sides thereof, and pushes the movable electrodes 50 toward second fixed electrodes 60 by generating electromagnetic force when current is applied from the outside.

In detail, the close coil 30 generates electromagnetic flux by using pulsed current applied from the outside, and current is induced in the movable electrodes 50, which are adjacent to the close coil 30, at induction plates 53 thereof by the generated electromagnetic flux. The induced current generates again electromagnetic flux in the induction plates 53. Herein, the electromagnetic flux is formed opposite to the electromagnetic flux of the close coil 30. Accordingly, repulsive force is generated in the induction plates 53 and the close coil 30. As a result, the close coil 30 pushes the induction plates 53 of the movable electrodes 50 toward the second fixed electrodes 60.

The open coils 40 are provided in the first fixed electrode 10 at both sides of the operating space 21 based on the close coil 30. The open coils 40 are respectively installed to be spaced apart from both sides of the close coil 30, and provide force to move the movable electrodes 50 to be far away from the second fixed electrodes 60. In other words, the open coils 40 generate electromagnetic force from induced current in the movable electrodes 50 at first ends thereof by using current applied from the outside, and move the movable electrodes 50 by using the generated electromagnetic force.

In detail, the open coils 40 generate electromagnetic flux by using pulsed current applied from the outside, current is induced in the induction plates 53 of the movable electrodes 50 adjacent to the close coil 30 by the electromagnetic flux. The induced current again generates electromagnetic flux in the induction plates 53. Herein, the electromagnetic flux is formed opposite to the electromagnetic flux of the close coil 30. Accordingly, repulsive force is generated in the induction plates 53 and the open coils 40. As a result, the open coils 40 pull the induction plates 53 of the movable electrodes 50 to be far away from the second fixed electrodes 60.

The movable electrodes 50 are installed in the first fixed electrode 20. The movable electrodes 50 straightly and reciprocally move between the first fixed electrode 20 and the second fixed electrodes 60, and selectively electrically connect the first fixed electrode 20 and the second fixed electrodes 60. In other words, since the movable electrodes 50 are connected to the first fixed electrode 20 through the contact springs 24, the movable electrodes 50 are always electrically connected to the first fixed electrode 20 regardless of movement, but are selectively electrically connected to the second fixed electrodes 60 by being connected thereto and by being separated therefrom.

The movable electrodes 50 respectively include moving bars 51. The moving bars 51 extend in moving directions of the movable electrodes, and are installed to pass through the through holes 22 of the first fixed electrode 20. In addition, induction plates 53 and operation plates 57 are respectively provided in the moving bars 51 at both sides thereof.

The induction plates 53 are provided on the first ends of the moving bars 51 facing the close coil 30, and are formed in a form of a metal plate having a relatively larger area than the moving bars 51. The induction plates 53 may be provided to be integrated with the moving bars 51, or may be provided separately and coupled to the moving bars 51.

Figure 4:
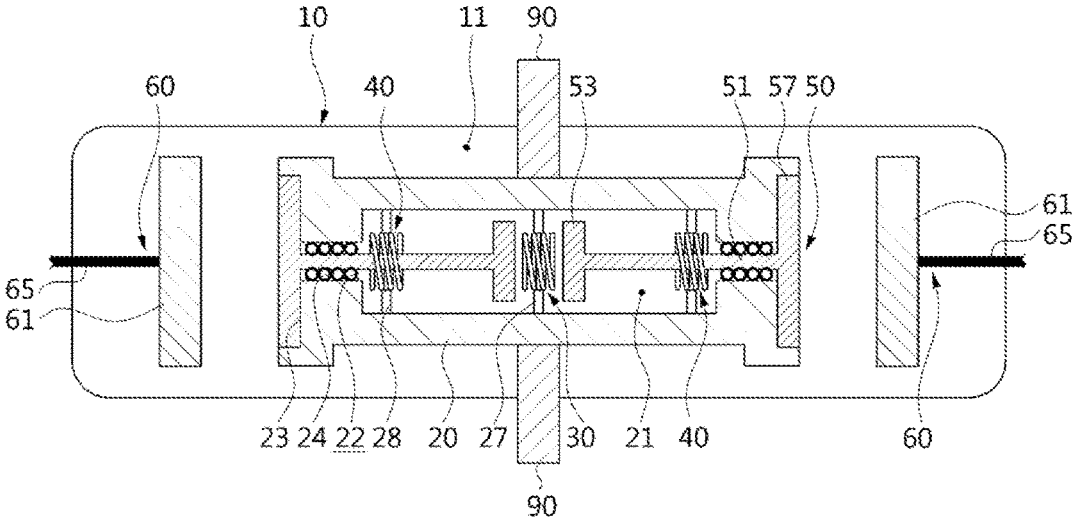
FIG. 4 is a conceptual diagram showing an opened state in which the movable electrodes and the second fixed electrodes which constitute the embodiment of the present invention have completely separated from each other.

The induction plates 53 generate electromagnetic flux by receiving induced current from the close coil 30, and the generated electromagnetic flux acts in a direction opposite to the electromagnetic flux of the close coil 30, thereby repulsive force is generated therebetween. Of course, the induction plates 53 receive induced current from the close coil 30 when the induction plates 53 are close to the close coil 30, as shown in FIG. 4.

In addition, the open coils 40 are installed in the induction plates 53 at second sides thereof, and when the induction plates 53 are adjacent to the open coils 40, repulsive force is generated therebetween by the same method, and on the contrary, the induction plates 53 receive force in a direction approaching to the close coil 30.

In addition, the close coil 30 is installed in the center of the operating space 21 of the first fixed electrode 20, and the open coils 40 are respectively installed to be spaced apart from both sides of the close coil 30, thus the induction plates 53 of the movable electrodes 50 straightly and reciprocally move between the open coils 40 and the close coil 30.

The operation plates 57 are disposed in the moving bars 51, which correspond to opposite sides of the induction plates 53, at second ends thereof, and are parts that selectively contact the second fixed electrodes 60. The operation plates 57 are formed in a form of a metal plate as the induction plates 53, and are provided outside the operating space 21 rather than inside.

The operation plates 57 selectively contact the second fixed electrodes 60 when the movable electrodes 50 move, and selectively electrically connect the second fixed electrodes 60 and the first fixed electrode 20. The operation plates 57 are placed in the seat portions 25 that are provided outside the first fixed electrode 20.

The second fixed electrodes 60 are disposed at both sides of the first fixed electrode 20. The second fixed electrodes 60 are spaced apart from the first fixed electrode 20, respectively installed inside the housing 10 at both sides thereof, and transfer power supplied from a first side to a second side by selectively contacting and electrically connected to the pair of movable electrodes 50.

Each of the second fixed electrodes 60 is configured with a fixed plate 61 and a connection part 65 connected to the fixed plate 61 and receiving/proving power from/to the outside.

Herein, the housing 10 includes insulating spacers 90. The insulating spacers 90 are used for installing the first fixed electrode 20 to be spaced apart from an inner surface of the housing 10. The insulating spacers 90 are made of an insulating material such as epoxy. The insulating spacers 90 may be provided to cover the outer surface of the first fixed electrode 20.

Each of the insulating spacers 90 may include a power supplier (not shown) therein. The power supplier is used for applying current to at least any one of the close coil 30 and the open coils 40 via the insulating spacers 90. For example, a wire used for applying current may extend and be connected to the close coil 30 or the open coils 40 through the inner space 11 of the insulating spacers 90, or may be respectively connected to both sides.

Hereinbelow, an operation process of an electromagnetic repulsion actuator for a circuit breaker of the present invention will be described in detail.

First, FIG. 1 shows an electromagnetic repulsion actuator according to the present invention which is in a closed state. In other words, in FIG. 1, the electromagnetic repulsion actuator according to the present invention is in a closed state and power is input thereto.

In detail, based on the figure, power provided from the outside is transferred to the second fixed electrode 60 disposed at a left side (arrow ① direction), and transferred to the movable electrode 50 by passing through the second fixed electrode (arrow ② direction). Herein, power is transferred since the second fixed electrode 60 contacts the operation plate 57 of the movable electrode 50.

Then, current moving along the movable electrodes 50 is transferred to the first fixed electrode 20 that contacts the movable electrode 50, whereby the current is transferred to the first fixed electrode 20 since the moving bar 51 of the movable electrode 50 always contacts the through hole 22 of the first fixed electrode 20 through the contact spring 24.

The current transferred to the first fixed electrode 20 moves along the first fixed electrode 20 (arrow ③ direction), and is transferred to the movable electrode 50 disposed at the opposite side (arrow ④ direction). Then, the current is transferred to the second fixed electrode 60 disposed at the opposite side. Thus, power is finally transferred and output to the opposite side (arrow ⑤ direction).

When the electromagnetic repulsion actuator maintains the above state and an abnormal signal is received, the electromagnetic repulsion actuator is opened by moving the movable electrodes 50. In other words, when an abnormal signal is received, current is applied to the open coils 40 from the outside, the open coils 40 generate electromagnetic force and apply repulsive force to the induction plates 53 of the movable electrodes 50. Accordingly, the contacted state between the movable electrodes 50 the second fixed electrodes 60 is released since the movable electrodes 50 move therefrom.

Figure 3:
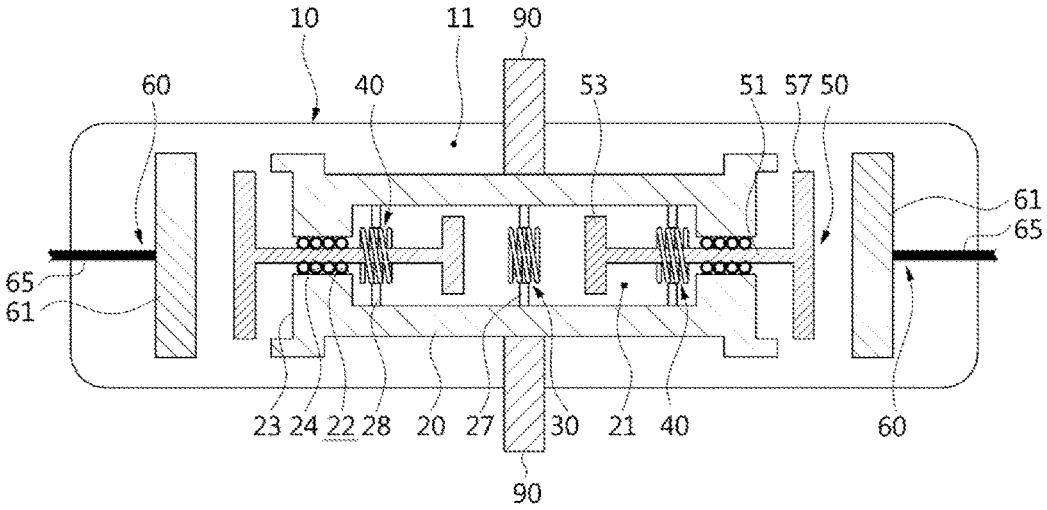
FIG. 3 is a conceptual diagram showing a state in which the movable electrodes and the second fixed electrodes which constitute the embodiment of the present invention start to separate from each other.

In detail, the open coils 40 generate electromagnetic flux by using pulsed current applied from outside, and current is induced in the induction plates 53 of the movable electrodes 50 which are adjacent to the close coil 30 by the generated generate electromagnetic flux. The induced current again generates electromagnetic flux in the induction plates 53. Herein, the electromagnetic flux is formed to a direction opposite to the electromagnetic flux of the close coil 30. Accordingly, repulsive force is in generated in the open coils 40 and the induction plates 53. As a result, the open coils 40 pull the induction plates 53 of the movable electrodes 50 to be far away from the second fixed electrodes 60. FIGS. 3 and 4 are views in which movements of the movable electrodes 50 are sequentially shown.

Herein, the movable electrodes 50 are configured in a pair, the pair of movable electrodes 50 simultaneously move toward the close coil 30 by the open coils 40, thus the stroke for moving the movable electrodes 50 for the open operation is halved. Accordingly, moving times of the movable electrodes 50 decrease, and blocking speed becomes fast.

In addition, when the abnormal signal is removed after the electromagnetic repulsion actuator is opened as described above, the close operation is performed again. The close operation may be performed by the close coil 30. When current is applied to the close coil 30, the close coil generates electromagnetic force, and applies repulsive force to the induction plates 53 of the movable electrodes 50. Accordingly, the pair of movable electrodes 50 move far away from each other, and the operation plates 57 contact the second fixed electrodes 60, thus the close operation is completed.

When the electromagnetic repulsion actuator becomes closed, the pair of movable electrodes 50 are respectively connected to the second fixed electrodes 60, thus two contact points are formed. Thus, the electromagnetic repulsion actuator may be applied to a relatively high-voltage circuit breaker.

In addition, the entire configuration of the electromagnetic repulsion actuator is simplified since a driving unit for driving two movable electrodes 50 is implemented by combining the open coils 40 and the close coil 30 rather than being separately implemented.

Even though it was described above that all of the components of an embodiment of the present invention are coupled as a single unit or coupled to be operated as a single unit, the present invention is not necessarily limited to such an embodiment. That is, at least two elements of all structural elements may be selectively joined and operate without departing from the scope of the present invention. In addition, since terms, such as "including", "comprising", and "having" mean that one or more corresponding components may exist unless they are specifically described to the contrary, it shall be construed that one or more other components can be included. All the terms that are technical, scientific or otherwise agree with the meanings as understood by a person skilled in the art unless defined to the contrary. Common terms as found in dictionaries should be interpreted in the context of the related technical writings not too ideally or impractically unless the present disclosure expressly defines them so.

Although the embodiments of the present invention have been described for illustrative purposes, those skilled in the art will appreciate that various modifications, additions and substitutions are possible, without departing from the scope and spirit of the invention. Accordingly, the embodiments disclosed in the present invention are not to limit but are merely to describe the technical spirit of the present invention. Further, the scope of the technical spirit of the present invention is not limited by the embodiments. The scope of the present invention shall be construed on the basis of the accompanying claims in such a manner that all of the technical ideas included within the scope equivalent to the claims belong to the present invention In the above embodiment, an electromagnetic repulsion actuator for a circuit breaker according to the present invention is described as a vacuum breaker that is installed in a vacuum environment. However, the electromagnetic repulsion actuator may be equally applied to a gas breaker applying insulating gas thereto.

In addition, in the present invention, the actuating coils 30 and 40 are configured with the close coil 30 and the open coils 40. However, the actuating coils 30 and 40 may be configured with any one of the close coil 30 or the open coils 40, and the actuating coils may move the movable electrodes 50 in backward/forward directions by selectively providing opposite direction electromotive force.

The invention claimed is:

1. An electromagnetic repulsion actuator for a circuit breaker, comprising:

a housing;

a first fixed electrode provided inside the housing and having therein an operating space open at both sides;

a pair of movable electrodes installed in the first fixed electrode at the both sides of the operating space thereof, the movable electrodes being capable of reciprocally moving and being electrically connected to the first fixed electrode;

second fixed electrodes respectively spaced apart from the first fixed electrode and installed inside the housing at both sides thereof, and selectively contacting the pair of movable electrodes to be electrically connected thereto, thereby transferring power supplied from a first side to a second side; and actuating coils selectively moving the movable electrodes in directions of being separated from the second fixed electrodes by generating electromagnetic force from induced current.

2. The electromagnetic repulsion actuator of claim 1, wherein each of the movable electrodes includes:

a moving bar extending in a moving direction of an associated movable electrode;

an induction plate provided on the moving bar at a first end facing a close coil; and an operation plate provided on the moving bar at a second end thereof opposite to the induction plate, and selectively contacting an associated second fixed electrode.

3. The electromagnetic repulsion actuator of claim 1, wherein the actuating coils include:

a close coil provided inside the operating space of the first fixed electrode, generating electromagnetic force from induced current in the movable electrodes at first ends thereof by using applied current, and moving the movable electrodes toward the second fixed electrodes;

open coils installed to be respectively spaced apart from both sides of the close coil, generating electromagnetic force from induced current in the movable electrodes at the first ends thereof by using applied current, and moving the movable electrodes so that the movable electrodes separate from the second fixed electrodes.

4. The electromagnetic repulsion actuator of claim 3, wherein the close coil is installed in the first fixed electrode at a center of the operating space thereof, the open coils are installed to be respectively spaced apart from both sides of the close coil, and the induction plates of the movable electrodes straightly and reciprocally move between the open coils and the close coil.

5. The electromagnetic repulsion actuator of claim 4, wherein the open coils are respectively installed in the first fixed electrode at the both sides of the operation space thereof, and push the pair of movable electrodes toward the close coil and selectively separate the operation plates of the movable electrodes from the second fixed electrodes.

6. The electromagnetic repulsion actuator of claim 2, wherein the first fixed electrode is provided with through holes having contact springs therein, the moving bars passing through the through holes, so that the contact springs electrically connect the moving bars and the first fixed electrode.

7. The electromagnetic repulsion actuator of claim 2, wherein the housing maintains a vacuum state therein.

8. The electromagnetic repulsion actuator of claim 1, wherein the first fixed electrode is installed to be spaced apart from an inner surface of the housing through insulating spacers.

9. The electromagnetic repulsion actuator of claim 8, wherein at least one of the close coil and the open coils is connected to a power supplier via the insulating spacers, the power supplier supplying current thereto.

10. The electromagnetic repulsion actuator of claim 2, wherein the actuating coils include:

a close coil provided inside the operating space of the first fixed electrode, generating electromagnetic force from induced current in the movable electrodes at first ends thereof by using applied current, and moving the movable electrodes toward the second fixed electrodes;

open coils installed to be respectively spaced apart from both sides of the close coil, generating electromagnetic force from induced current in the movable electrodes at the first ends thereof by using applied current, and moving the movable electrodes so that the movable electrodes separate from the second fixed electrodes.

* * * * *